US009266544B2

(12) United States Patent
Van Den Abeele et al.

(10) Patent No.: US 9,266,544 B2
(45) Date of Patent: Feb. 23, 2016

(54) METHOD FOR TRANSFERRING ALARM DATA BETWEEN A BROKEN-DOWN RAILWAY VEHICLE AND A CONTROL CENTER AND ASSOCIATED DEVICE

(75) Inventors: Didier Van Den Abeele, Asnieres sur Oise (FR); Marion Berbineau, Marne la Vallee (FR); Martine Wahl, Marne la Vallee (FR)

(73) Assignee: ALSTROM TRANSPORT TECHNOLOGIES, Levallois-Perret (FR)

( * ) Notice: Subject to any disclaimer, the term of this patent is extended or adjusted under 35 U.S.C. 154(b) by 1030 days.

(21) Appl. No.: 13/266,819

(22) PCT Filed: Apr. 30, 2010

(86) PCT No.: PCT/FR2010/050829

§ 371 (c)(1),
(2), (4) Date: Jun. 13, 2012

(87) PCT Pub. No.: WO2010/125321

PCT Pub. Date: Nov. 4, 2010

(65) Prior Publication Data

US 2012/0242484 A1 Sep. 27, 2012

(30) Foreign Application Priority Data

Apr. 30, 2009 (FR) ..... 09 52875

(51) Int. Cl.
*G08B 1/08* (2006.01)
*B61L 27/00* (2006.01)
*B61L 15/00* (2006.01)

(52) U.S. Cl.
CPC ..... *B61L 27/0005* (2013.01); *B61L 15/0027* (2013.01); *B61L 27/0094* (2013.01)

(58) Field of Classification Search
None
See application file for complete search history.

(56) References Cited

U.S. PATENT DOCUMENTS

| | | | | |
|---|---|---|---|---|
| 5,496,003 | A * | 3/1996 | Bernard | 246/29 R |
| 6,580,981 | B1 * | 6/2003 | Masood et al. | 701/29.3 |
| 6,634,000 | B1 | 10/2003 | Jammu | |
| 7,188,341 | B1 | 3/2007 | Hawthore et al. | |
| 2002/0062182 | A1 * | 5/2002 | Sato et al. | 701/19 |
| 2005/0064895 | A1 * | 3/2005 | Oesterling et al. | 455/553.1 |
| 2005/0133673 | A1 * | 6/2005 | Sugita et al. | 246/167 R |
| 2005/0174974 | A1 * | 8/2005 | Sonntag et al. | 370/338 |

(Continued)

FOREIGN PATENT DOCUMENTS

| | | | |
|---|---|---|---|
| EP | 1900597 | A1 | 3/2008 |
| WO | 0123238 | A1 | 4/2001 |
| WO | 03090365 | A2 | 10/2003 |

*Primary Examiner* — Curtis King
(74) *Attorney, Agent, or Firm* — Dowell & Dowell, PC

(57) ABSTRACT

The invention relates to a method for transferring alarm data between a first broken-down train (A) and a control center (2) comprising: evaluating the state of the first train; and then the state of the first train corresponding to a break down; determining if it is possible to establish a first link between the first train and a ground infrastructure (1) connected to the center; if not, establishing a backup radio link between first independent communication means (50) of the first train and second independent communication means (50') of a second train rolling in the vicinity of the first train; transferring the alarm data concerning the first train and storing the same into storage means of the second train; establishing a second link between the second train and the ground infrastructure and transferring the alarm data concerning the first train from the second train to the center.

8 Claims, 2 Drawing Sheets

(56) References Cited

U.S. PATENT DOCUMENTS

2007/0208841 A1* 9/2007 Barone et al. ..... 709/223
2007/0213005 A1 9/2007 Hsiao
2010/0204857 A1 8/2010 Forrest et al.
2011/0222426 A1* 9/2011 Chazel et al. ..... 370/252
2014/0161022 A1* 6/2014 Yamaguchi et al. ..... 370/315
2014/0323139 A1* 10/2014 LEE et al. ..... 455/447

* cited by examiner

METHOD FOR TRANSFERRING ALARM DATA BETWEEN A BROKEN-DOWN RAILWAY VEHICLE AND A CONTROL CENTER AND ASSOCIATED DEVICE

BACKGROUND OF THE INVENTION

1. Field of the Invention

The invention relates to the field of methods for transferring alarm data between a broken-down railway vehicle and a control center, as well as devices for carrying out such methods.

When a train, or any other railway vehicle such as a subway, tramway or equivalent, breaks down on the middle of a track, the operator of that train wishes for a rapid and adapted intervention to minimize the impact of that breakdown in terms of penalties related to an untimely occupation of the track, costs due to inappropriate referral of the train to a maintenance workshop, disorganization of traffic, inconveniences caused to the passengers of the broken-down train and those of trains whereof the travel is disrupted, etc.

2. Brief Discussion of the Related Art

Trains today are equipped with maintenance means able to determine an operating state of the train from different parameters.

When a train breaks down, these maintenance means inform a fixed control center, on the ground, by transferring it alarm data. This alarm data includes at least one identifier of the train, an alarm signal and secondary data relative to the state of the broken-down train. This information allows the control center, by implementing expert data processing means, to try to diagnose the nature of the breakdown, develop an intervention strategy and mobilize the means adapted to perform that intervention.

The communication between a train and the control center is done through a ground communication infrastructure making it possible to establish a wireless connection. A train is equipped with communication means adapted to establish such a wireless connection. The wireless connection is established periodically, when the train is located within the coverage zone of the communication infrastructure on the ground. This coverage zone generally includes train stations, maintenance workshops, certain important points of the rail network, but does not cover all of the tracks that the trains in a fleet of trains may use.

However, a train can break down and be immobilized on the track at a point that does not belong to the coverage zone of the ground communication infrastructure. It is then impossible for the broken-down train to establish a communication link with the ground infrastructure, and, consequently, to inform the control center of the situation. The intervention chain is not triggered.

More generally, the fact that the broken-down train cannot establish a link with the ground infrastructure includes a number of situations: the broken-down train may be located outside the coverage zone of the ground communication infrastructure, and it is impossible to establish any wireless link whatsoever; the broken-down train can be located in the coverage zone of the ground communication infrastructure, but the quality of the link between the broken-down train and the ground infrastructure is greatly damaged because, for example, of a screening phenomenon due to electromagnetic disruptions or the presence of another train concealing a wireless access point in a tunnel; lastly, the breakdown that affects the train can in fact affect the wireless communication means normally used to establish a wireless link between the train and the ground infrastructure or the train's onboard computer, which implements the maintenance means.

SUMMARY OF THE INVENTION

The invention therefore aims to transfer, irrespective of the breakdown, alarm data from a broken-down train toward a control center, whereas the broken-down train cannot establish a primary communication link with the ground infrastructure, connection normally used for maintenance communications between the train and the control center.

The invention relates to a method according to claim 1, an onboard system according to claim 8 and an architecture according to claim 14.

BRIEF DESCRIPTION OF THE DRAWINGS

The invention and its advantages will appear more clearly upon reading the following description, provided solely as an example, and done in reference to the appended drawings, in which.

DESCRIPTION OF THE PREFERRED EMBODIMENTS

Figure 1:
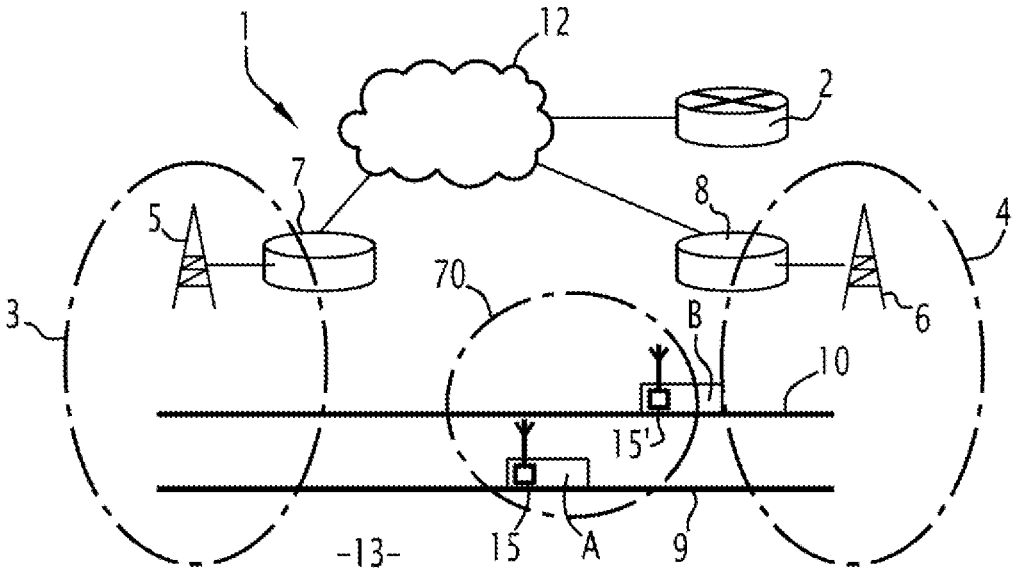
FIG. 1 is a diagrammatic illustration of the situation in which the method according to the invention is implemented.

FIG. 1 shows a first train A traveling along a railway track 9. Among the other trains of the fleet of trains to be monitored, a second train B is shown, which travels along a railway track 10 parallel to the track 9.

The communication architecture includes a ground communication infrastructure 1, preferably private. The ground infrastructure 1 is connected to a network 12, for example public, such as the Internet. A control center 2 is connected to said network 12. The control center 2 includes expert data analysis means to monitor the fleet of trains.

The infrastructure 1 includes a plurality of base stations, such as base stations 7 and 8. Each base station 7, 8 includes radio transmission and reception means 5, 6 making it possible to establish a wireless link with a mobile device located inside the cell 3, 4, covered by the base station 7, 8.

The union of the various cells 3, 4 of the infrastructure 1 makes up the coverage area of the infrastructure 1. As shown in FIG. 1, this coverage area does not cover all of the tracks 9 and 10. A shadow region 13 exists, for example situated between the cells 3 and 4, inside which it is impossible for a mobile device to be in radio connection with the infrastructure 1.

Each of the trains of said fleet of trains to be monitored, such as trains A and B, is equipped with a same equipment and software system. The system 15 of train A is shown diagrammatically in FIG. 2. The system 15' of train B is identical to the system 15. The reference borne by a component of the system 15' of train B is obtained by "priming" the reference borne by the same component of the system 15 of train A.

The system 15 includes an onboard computer 16. The onboard computer 16 includes a computation unit 17, as well as storage means 18 of the RAM or ROM type. The onboard computer 16 is connected, via an adapted input/output interface 19, to a local network 20 onboard train A. Different sensors, such as sensors 22 and 24, are connected to the onboard computer 16 via the local network 20.

The onboard computer 16 includes, inter alia, a maintenance software module 30. The maintenance software module 30 is made up of a series of instructions stored in the storage means 18 and able to be executed periodically by the computation unit 17.

The maintenance module 30 can determine a plurality of indicators as a function of numerous parameters, the values of which are measured by the different sensors 22, 24. The value of a parameter can be a value measured at the present moment, or a value measured at a past moment and stored in a history of values of the considered parameter.

The maintenance module 30 can synthesize the different indicators in a global variable called "operating state of the train." The operating state of the train is for example binary, "normal" or "broken down."

The history of the values of a parameter is stored in the storage means 18. The instantaneous values of the different indicators and the operating state of the train are recorded in a status journal, stored in the storage means 18.

The system 15 also includes a primary radio communication device 40 dedicated to establishing a primary wireless communication link with one of the base stations 7, 8 of the ground infrastructure 1. The primary device 40 makes it possible to establish a link of the GSM type and to communicate data along that link according to a predetermined protocol, for example of the TCP/IP type. One skilled in the art knows how to implement such a primary communication link. Alternatively, other types of primary link can be implemented.

Lastly, the system 15 includes a backup communication device 50 dedicated to establishing a backup radio communication link with a backup communication device 50' equipping another train, such as train B.

More specifically, the backup device 50 includes:

- a primary electronic card, including computation means 51 and storage means 52;
- an input/output interface 54 for connecting the backup device 50 to the local network 20 and the two-way exchange of information with the onboard computer 16 according to a predetermined protocol;
- means 56 for transmitting and receiving radio waves operating, by default, in a particular mode, called "default" resources; and
- electrical power means, such as a battery 58, to make the backup communication device 50 autonomous.

The device 50 is autonomous relative to the other equipment of train A so that it can operate irrespective of the breakdown affecting the train and, in particular, a breakdown affecting the onboard computer 16 of train A and/or the primary communication device 40 of train A.

Figure 2:
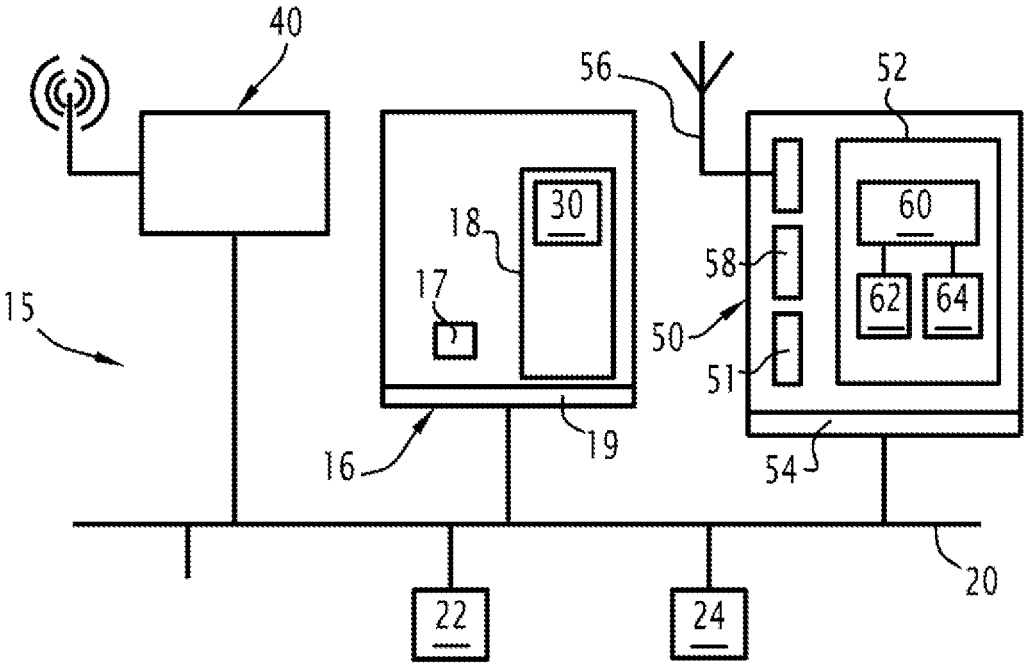
FIG. 2 diagrammatically illustrates the onboard system on a train, and in particular an independent backup communication device; and, FIG. 3 is an illustration in the form of an algorithm of the different elementary steps making it possible to transfer alarm data from a broken-down train toward the control center, via a relay train.

The primary electronic card can execute different software modules diagrammatically illustrated in FIG. 2:

- a backup communication module 60, which makes it possible to synchronize the execution of different modules and prepare the data messages to be transmitted, in formats according to predefined protocols;
- a negotiation module 62 able to negotiate radio resources dynamically and to choose the adapted resource to establish the backup link from among the different available resources. This choice is made as a function of the volume of alarm data to be transmitted from one train to the other, the speed of the relay train, etc.
- a configuration module 64 that, when it is executed, makes it possible to configure the radio transmission and receiving means 56 as a function of the characteristics of the resource that has been negotiated. Thus, depending on the resource to be used, the radio transmission and reception means 56 are configured in GSM-R transmission mode, or GPSR mode, or WiFi mode.

The method implemented by the means just described is as follows.

Figure 3:
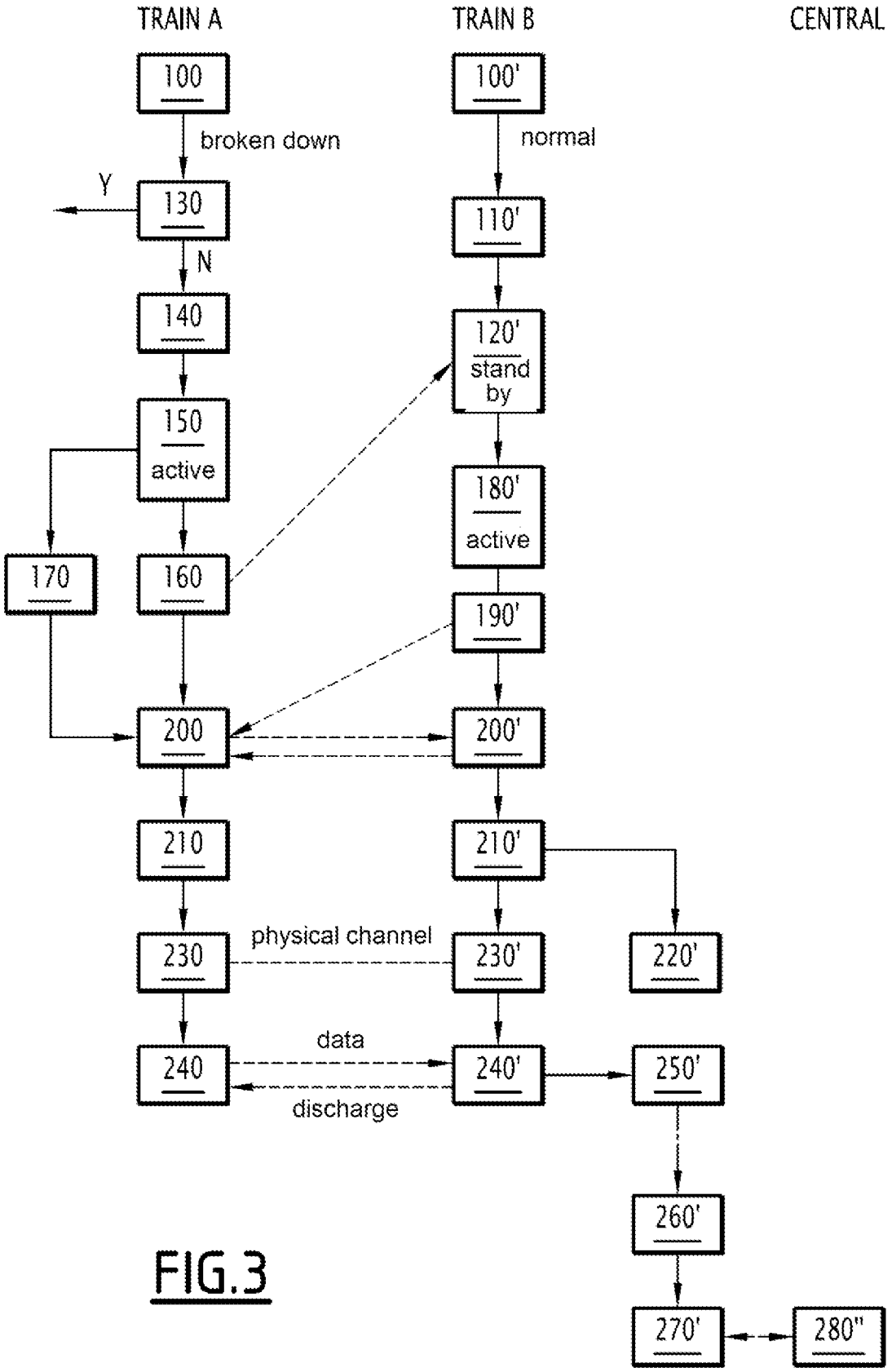

Diagrammatically illustrated in FIG. 3 is the chain of steps of the method making it possible to alert the control center 2 of the presence of a broken-down train. In the following, it is train A that is broken down and immobilized outside the coverage region of the infrastructure 1, while train B, which is operating normally, will serve as a relay for communication between the broken-down train and the control center.

Periodically, by executing the maintenance module 30, an onboard computer, whether the computer 16 of train A or the computer 16' of train B, determines the current operating state of the train (in FIG. 3, step 100 for train A and step 100' for train B).

During normal operation, which is the case for train B, the onboard computer regularly sends the backup device of the train a flag indicating that the train is in a normal operating state (step 110' for train B). As long as the backup device receives this flag, it operates in a standby mode (step 120' for train B). In this standby mode, the backup device continuously listens to its wireless environment with the aim of detecting any broken-down train. The radio reception and transmission means then operate in "default" mode.

When the onboard computer determines that the operating state of the train is "broken down," which is the case for train A, it first tries to communicate that information to the control center 2 via a primary radio communication link that will be established between the primary communication device 40 of the broken-down train A and the ground infrastructure 1 (step 130 for train A).

When, after several attempts, the primary communication device 40 responds to the onboard computer 16 of train A that it is impossible to establish a communication link with the ground infrastructure 1, the onboard computer 16 of train A sends the backup communication device 50 of train A a flag indicating a broken-down operating state (step 140).

When the backup communication device 50 receives a flag indicating a broken-down operating state, it switches from the "standby" mode to the "active" mode (step 150). The device 50 goes to active mode in other situations, for example when it no longer receives operating state flags from the onboard computer 16, or, the driver's cab being equipped with a signaling switch, when the driver actuates the signaling switch so that a flag is transmitted equivalent to a flag indicating a broken-down operating state toward the device 50. It will be noted that this last functionality makes it possible to prevent the onboard computer 16 from being the mandatory passage means in the breakdown detection chain.

In the "active" mode, the communication module 60 of the broken-down train A seeks to establish a backup radio communication link with another train, such as train B, which may serve to relay the alarm data to notify the control center 2 as quickly as possible.

To that end (step 160), the communication module 60 generates a preliminary signal that is transmitted periodically, in the form of beacons, by the transmitting and receiving means 56 configured in "default" operating mode, to inform the environment 70 that train A is broken down. It will be noted that the environment 70 associated with train A corresponds to the coverage region of the radio transmitting and receiving means 56 in the "default" mode.

In parallel (step 170), the communication module 60 launches the execution of the negotiation module 62 by giving it certain parameters, such as the quantity of alarm data to be transferred, so that it prepares a list of available radio resources that can be used to establish a wireless link implementing a particular data transmission protocol.

The backup device 50' of train B, in "standby" mode, listens on a broad spectral band to its wireless environment. When the backup device 50' of train B detects a preliminary signaling beacon, it switches from "standby" mode to "active" mode (step 180'). It transmits a response message intended for the backup device 50 of train A to initiate the process of establishing a wireless backup radio link (step 190').

A step for negotiating the radio resource to be used is carried out by the negotiation modules 62 and 62' of trains A and B, respectively (step 200 for train A and step 200' for train B). The module 62 proposes the first resource in the list of available resources that it has previously established. The module 62' responds by indicating whether this resources exists and is available on the side of train B. If the response from the module 62' is negative, the module 62 proposes the following resource in the list of resources.

If the response from the module 62' of train B is positive, the configuration modules 64 and 64' are executed (step 210 for train A, step 210' for train B) to configure the transmitting and receiving means 56 and 56' of each of trains A and B.

In parallel (step 220'), depending on the flows of alarm data to be transferred and the characteristics of the negotiated resource, the communication means 60' of train B estimate the time during which the backup link must be maintained to transfer all of the alarm data relative to train A. The means 60' transmit that information to the onboard computer 16' of train B. The latter will take that information into account to regulate the speed of train B in zone 70.

Once the means 56 and 56' are configured, the communication modules 60 and 60' establish a communication channel by implementing the means adapted to connect the services, i.e. the different layers of the communication protocol of the wireless link (physical layers and data link 1 and 2 of the OSI model) (step 230 for train A and 230' for train B).

Then (step 240 for train A and 240' for train B), once the physical layer of the link is created, the communication modules 60 and 60' exchange data according to the negotiated protocol. The backup device 50 of train A transmits a series of messages. Each message includes a particular alarm datum. Knowing that the backup link has a reduced duration and risks being cut, the alarm data to be transferred from train A to train B is prioritized using a priority criterion. The alarm data having a high priority is transmitted first.

The alarm data includes priority data, such as an identifier of train A, an alarm signal indicating that train A is broken down, the position of train A, and secondary data, such as a code indicating the nature of the breakdown, secondary indicators that have been calculated by the maintenance module 30 of train A, parameters of train A, etc.

In case of proper receipt of the $n^{th}$ data message, the device 50' of train B responds by transmitting a global discharge message for the data n.

At the end of receipt of all of the alarm data, the device 50' of train B responds by transmitting a global discharge message.

Possibly, if the backup radio link has been broken before the communication device 50 of the broken-down train A has received a global discharge message, the backup device 50 of train A stores the value n of the last discharge message received from the relay train B. The backup device 50 of train A seeks again (return to step 160) to establish another backup link with another train C passing near train A. When that other backup link is established, the device 50, after having again transmitted the priority alarm data, will continue to transmit alarm data starting at the $n+1^{th}$ alarm datum. The synthesis between the two alarm data packets relative to train A will be done by the control center 2.

The different alarm data relative to train A transferred to train B is recorded in the storage means 52' of the primary card of the backup device 50' of train B (step 250').

The backup link is broken and train B continues its journey.

When it comes back into the coverage region of the ground infrastructure 1, train B establishes (step 260') a primary communication link with a base station, for example the base station 7 of the ground infrastructure 1. To that end, it uses its primary communication device 40'.

The backup communication module 60' indicates to the onboard computer 16' that it needs to transmit alarm data. Once the primary link is established, the onboard computer 16' of train B asks the backup communication device 50' for the alarm data to be transmitted and uses the primary communication device 40' for that transmission. Train B transmits (step 270') the alarm data relative to train A, intended for the control center 2. The ground infrastructure 1 conveys that alarm data to the control center 2, which will process it (step 280") as necessary.

The backup device 50' of train B remains in "active" mode and transfers the alarm data relative to train A toward the other trains that train B encounters. In this way, through a cascade effect, a large number of trains in the fleet of trains to be monitored are aware of the existence of the broken-down train A. Furthermore, the time necessary to notify the control center 2 is minimized, as it may not be train B, having received the alarm data by a first "hop," which may establish a first link with the ground infrastructure, but another train in the fleet having received the alarm data by an $i^{th}$ hop.

For downlink communication, from the control center 2 toward the broken-down train A, a similar process is considered that uses a relay train B. The control center 2 includes a list of trains in the traveling fleet and their itinerary. The control center 2 selects the train to be used as relay to transfer information or requests to the broken-down train A as quickly as possible. The information is first transferred to the relay train B. Then, train B moves as far as the coverage region 70 of the radio transmission and reception means of trains A and B. Once the backup link is established, the information and requests are transferred to train A and processed on the onboard computer 16 of train A.

In the aforementioned case, where the backup communication device is activated by switching a cab signaling switch, the alarm data transmitted by the backup communication device to the control center is a preformatted message.

The inventive system, which incorporates a dedicated autonomous backup communication device, guarantees great reliability in the conveyance of alarm data from the broken-down train to the control center managing the exploitation of the network.

The invention claimed is:

1. A method for transferring alarm data between a first broken-down train and a control center, consisting of:

evaluating the operating state of said first train; and, when the operating state of said train corresponds to a breakdown, determining whether it is possible to use a first primary radio communication link between a primary communication device of said first broken-down train and a ground infrastructure to which said control center is connected; and, if not, establishing a backup radio communication link between a first autonomous backup communication device of said first train and a second autonomous backup communication device of a second train that passes through a coverage region of said first autonomous backup communication means;

once said backup radio communication link is established, transferring, from the first train to the second train, the alarm data relative to the first train;

storing said alarm data relative to the first train in storage means of said second train;

transmitting said alarm data relative to the first train to a primary communication device of said second train;

transferring the alarm data relative to the first train, by using a second primary radio communication link between the primary communication device of said second train and the ground infrastructure; and, at the control center, developing an intervention strategy according to the alarm data relative to the first train that has been received, wherein, to establish the backup communication link, said first autonomous backup communication device of the first train transmits a preliminary signaling beacon informing a wireless environment of the first train that the latter is broken down, wherein the second autonomous backup communication device of the second train being, by default, in a standby mode, it continuously listens to a wireless environment of the second train and, upon receipt of a preliminary signaling beacon from said first train, the second communication device switches into an active mode and answers said first backup communication device of the first train to establish the backup link, and wherein, after the answer from the second autonomous backup communication device, the first and second backup communication devices negotiate, among available wireless resources, the resource to be used to establish the backup communication link.

2. The method according to claim 1, wherein, at the end of the step for negotiating a resource to be used, the first and second autonomous backup communication devices reconfigure their respective radio transceiver means to establish a link using the negotiated resource.

3. The method according to claim 1, wherein said second train adapts its speed to maintain the backup communication link during a sufficient period of time to transfer all of the alarm data from said first train to said second train.

4. A system onboard a train including:

a maintenance means for the evaluation of an operating state of said train;

a primary communication device, dedicated to establishing a first primary radio communication link between said train and a ground infrastructure to which a control center is connected, the primary radio communication device including means for the determination of whether or not it is possible, at the considered moment, to establish such a first primary radio communication link; and, an autonomous backup communication device, dedicated to establishing a backup radio communication link between said autonomous backup communication device onboard said train and another autonomous backup communication device onboard another train that passes through a coverage region of said autonomous backup communication device, the backup radio communication link being dedicated to the transfer of alarm data relative to said other train; the autonomous backup communication device comprising storage means for storing the alarm data relative to said other train; the autonomous backup communication device transmitting the alarm data relative to said other train to the primary communication device; and the primary communication device transferring to the ground infrastructure the alarm data relative to said train and/or the alarm data relative to said other train, using the first primary radio communication link, wherein the autonomous backup communication device includes:

computation means and storage means;

interface means for connection between said computation means and said storage means and said maintenance means;

radio transmission and reception means connected to said computation means and said storage means;

an electrical power source to supply electrical power to said autonomous backup communication device, means for generating a preliminary signal, said preliminary signal being transmitted to the radio transmission and reception means so that the radio transmission and reception means periodically transmit said preliminary signal as a preliminary signal beacon, and negotiation means selecting a resource among a list of wireless resources to establish the backup communication link with said other autonomous backup communication device onboard another train.

5. The system according to claim 4, wherein the autonomous backup communication device includes configuration means for the configuration of the radio transmission and reception means according to the negotiated resource.

6. The system according to claim 4, wherein said computation means and said storage means of said autonomous backup communication device exchange alarm data and discharge messages, according to a predetermined protocol, with another autonomous backup communication device.

7. The system according to claim 4, wherein said computation means and said storage means compute a maintenance period of the backup radio link, and in that the system includes means for regulating a speed of said train, able to regulate the speed of the train as a function of said computed maintenance period.

8. A communication architecture including:

a first system according to claim 4 onboard a first train;

a second system according to claim 4 onboard a second train, the first and second systems being able to establish between them, using their autonomous backup communication devices, a backup radio communication link;

a ground communication infrastructure including a plurality of base stations, each base station being adapted to establish a primary communication link with a primary communication device of the first and second systems, when the train on which said at least one system is onboard is located inside a cell covered by the considered base station; and a control center connected to said ground communication infrastructure.

* * * * *